US008418782B2

(12) United States Patent
Waters et al.

(10) Patent No.: US 8,418,782 B2
(45) Date of Patent: Apr. 16, 2013

(54) METHOD AND SYSTEM FOR PRECISE DRILLING GUIDANCE OF TWIN WELLS

(75) Inventors: Robert L. Waters, Austin, TX (US); Edwin Meador, Stafford, TX (US)

(73) Assignee: General Electric Company, Schenectady, NY (US)

( * ) Notice: Subject to any disclaimer, the term of this patent is extended or adjusted under 35 U.S.C. 154(b) by 333 days.

(21) Appl. No.: 12/352,288

(22) Filed: Jan. 12, 2009

(65) Prior Publication Data

US 2009/0178850 A1 Jul. 16, 2009

Related U.S. Application Data

(63) Continuation-in-part of application No. 10/998,781, filed on Nov. 30, 2004, now Pat. No. 7,475,741.

(51) Int. Cl.
*E21B 7/04* (2006.01)
*E21B 47/02* (2006.01)

(52) U.S. Cl.
USPC ..... 175/45; 175/61

(58) Field of Classification Search ..... 175/61, 175/73, 45; 324/326, 207.17, 346
See application file for complete search history.

(56) References Cited

U.S. PATENT DOCUMENTS 3,285,350 A * 11/1966 Henderson ..... 340/853.5
3,725,777 A 4/1973 Robinson et al.
4,072,200 A 2/1978 Morris et al.
4,458,767 A 7/1984 Hoehn, Jr.
4,465,140 A 8/1984 Hoehn, Jr.
4,593,770 A 6/1986 Hoehn, Jr.
4,710,708 A 12/1987 Rorden et al.
4,791,373 A 12/1988 Kuckes
4,875,014 A 10/1989 Roberts et al.
5,064,006 A 11/1991 Waters et al.
5,074,365 A 12/1991 Kuckes
5,155,916 A 10/1992 Engebretson
5,218,301 A 6/1993 Kuckes
5,230,387 A 7/1993 Waters et al.
5,343,152 A * 8/1994 Kuckes ..... 324/346
5,398,421 A 3/1995 Nicolle et al.
5,435,069 A 7/1995 Nicholson
5,452,518 A 9/1995 DiPersio
5,485,089 A 1/1996 Kuckes
5,512,830 A 4/1996 Kuckes
5,564,193 A 10/1996 Brooks
5,589,775 A 12/1996 Kuckes
5,657,826 A 8/1997 Kuckes
5,676,212 A * 10/1997 Kuckes ..... 175/45
5,725,059 A 3/1998 Kuckes et al.
5,923,170 A 7/1999 Kuckes (Continued)

OTHER PUBLICATIONS

MagTraC Scientific Drilling brochure, (five pages), (prior to Jun. 2004).

(Continued)

*Primary Examiner* — Brad Harcourt
(74) *Attorney, Agent, or Firm* — Hiscock & Barclay LLP

(57) ABSTRACT

A method to guide a drilling path of a second well in proximity to a first well including: applying a time-varying electrical current to a conductive casing or liner of the first well; from the drilling path of the second well, sensing an electromagnetic field generated by the current in the first well, and guiding the drilling path trajectory of the second well using the sensed electromagnetic field.

3 Claims, 5 Drawing Sheets

U.S. PATENT DOCUMENTS

| | | | |
|---|---|---|---|
| 6,152,246 | A | 11/2000 | King et al. |
| 6,466,020 | B2 | 10/2002 | Kuckes et al. |
| 6,530,154 | B2 | 3/2003 | Towle |
| 6,608,565 | B1 | 8/2003 | Van Steenwyk et al. |
| 6,626,252 | B1 | 9/2003 | Kuckes |
| 6,651,496 | B2 | 11/2003 | Van Steenwyk et al. |
| 6,736,222 | B2 | 5/2004 | Kuckes et al. |
| 6,814,163 | B2 | 11/2004 | Kuckes |
| 6,927,741 | B2 | 8/2005 | Brune et al. |
| 7,219,749 | B2 | 5/2007 | Kuckes |
| 7,475,741 | B2 | 1/2009 | Waters |
| 2002/0112856 | A1 | 8/2002 | Van Steenwyk et al. |
| 2003/0041661 | A1 | 3/2003 | Van Steenwyk et al. |
| 2003/0220743 | A1 | 11/2003 | Van Steenwyk et al. |
| 2004/0020691 | A1 | 2/2004 | Krueger |
| 2004/0159466 | A1 | 8/2004 | Haugen et al. |
| 2004/0160223 | A1 | 8/2004 | McElhinney |
| 2009/0120691 | A1 | 5/2009 | Waters et al. |

OTHER PUBLICATIONS

MagTraC Scientific Drilling brochure, MagTraC, (one page), (Jun. 2003).

* cited by examiner

METHOD AND SYSTEM FOR PRECISE DRILLING GUIDANCE OF TWIN WELLS

RELATED APPLICATION

This application is a continuation-in-part of U.S. non-provisional patent application Ser. No. 10/998,781 (U.S. Pat. No. 7,475,741), filed Nov. 30, 2004, the entirety of which is incorporated by reference.

BACKGROUND OF THE INVENTION

The present invention relates to the field of well drilling guidance and, in particular, to guidance systems that use electromagnetic fields associated with an existing well casing to steer the drilling of a second well proximate to the first well casing.

There is often a need to drill a second well adjacent an existing well. For example, a pair of horizontal wells may be drilled to extract oil from a deposit of heavy oil or tar. A horizontal well includes well having a section that is truly horizontal through the earth and wells in which the "horizontal" section is slanted up or downhill to track the interface of an oil (or other resource) the producing formation in the earth. Thus, the horizontal portion of the well may not be geometrically horizontal and rather may follow a path that tracks a formation in the earth. Of the pair of wells, an upper well may inject steam into a subterranean deposit of heavy oil or tar while the lower well collects liquefied oil from the deposit. The pair of wells are to be positioned within a few meters of each other along their lengths, especially the lateral portions of the wells that typically extend horizontally. The wells are positioned proximate to each other so that, for example, the oil liquefied by the steam from the first well can be collected by the second well.

There is a long-felt need for methods to drill wells, e.g., a pair of wells, in juxtaposition. Aligning a second well with respect to a first well is difficult. The drilling path of the second well may be specified to be within a few meters, e.g., 4 to 10 meters, of the first well, and held to within a tolerance, for example, of plus or minus 1 meter, of the desired drilling path. Drilling guidance methods and system are needed to ensure that the drilling path of the second well remains properly aligned with the first well along the entire drilling path of the second well.

Surveying the drilling path at successive points along the path is a conventional drilling guidance method. A difficulty with typical surveying is that a cumulative error arises in the surveyed well path because small errors made at each successive survey point along the well path are introduced into the survey calculation made at subsequent survey points. The cumulative effect of these small errors may eventually cause the drilling path of the second well to drift outside the specified desired ranges of distance or direction relative to the first well.

U.S. Pat. Nos. 6,530,154; 5,435,069; 5,230,387; 5,512,830 and 3,725,777, and Published US Patent Application 2002/0112,856 disclose various drilling guidance methods and systems to provide drilling path guidance and to compensate for the cumulative effect of conventional survey errors. These known techniques include sensing a magnetic field generated by the magnetic properties of a well casing or a magnetic probe introduced into the well. These methods and systems may require the use a second rig or other device in the first well to push or pump down a magnetic signal source device. The magnetic fields from such a source are subject to magnetic attenuation and distortion by the first well casing, and may also generate a relatively weak magnetic field that is difficult to sense from the desired second well drilling path. In view of these difficulties, there remains a long felt need for a method and system to guide the trajectory of a second well such that it is aligned with an existing well.

BRIEF DESCRIPTION OF THE INVENTION

A system and method have been developed to precisely guide the drilling trajectory of a second well in a manner that ensures that the second well is properly aligned with a first well. In one embodiment, a metallic casing in the first well conducts an alternating current that generates an alternating magnetic field in the earth surrounding the first well. This magnetic field is substantially more predictable in magnitude than would be a magnetic field due solely to the static magnetic properties of the first well. The intended drilling trajectory of the second well is within the measurable magnetic field generated by the current in the first well. A magnetic detector is included within the drilling assembly used for guiding the boring of the second hole. The magnetic detector senses the magnetic field generated by the alternating current in the first well. Values measured of strength and direction of the magnetic field are used to align the trajectory of the drilling assembly drilling the hole for the second well.

The system may be used to guide a second horizontal well being drilled near a first horizontal well to enhance oil production from subterranean reservoirs of heavy oil or tar sands. The two parallel wells may be positioned one above the other and separated by a certain distance, e.g., within the range of 4 to 10 meters, through a horizontal section of a heavy oil or tar deposit. In one embodiment, the method guides a drilling path so that the second horizontal well is a consistent and short distance from the first well by: (1) causing a known electrical current to flow in the metallic casing or liner (collectively "casing") of the first well to produce a continuous magnetic field in the region about the first well, and (2) using magnetic field sensing instruments in the second well while drilling to measure and calculate accurate distance and direction information relative to the first well so that the driller can correct the trajectory of the second well and position the second well in the desired relationship to the first well.

In another embodiment the invention is a method to guide a drilling path of a second well in proximity to a first well including: applying a time-varying electrical current to a conductor placed inside the casing of the first well; from the drilling path of the second well, sensing an electromagnetic field generated by the current in the conductor, and guiding the drilling path trajectory of the second well using the sensed electromagnetic field.

The inventive method may be a method to guide the drilling path of a second well in proximity to a first well comprising: drilling a third well towards a distal section of the first well and establishing a conductive path along the third well to the distal section of the first well; forming an electrical circuit comprising an electrical generator, a conductive casing of the first well and the conductive path along the third well, wherein said generator applies a time-varying electrical current to the circuit; from the drilling path of the second well, sensing an electromagnetic field generated by the current in the first well, and guiding the drilling path of the second well using the sensed electromagnetic field.

The invention may also be embodied as a drilling guidance system for guiding a drilling path of a second well in proximity to a first well, said system comprising: a first conductive path extending a length of the first well; a generator of electrical current connected to opposite ends of the first well to apply current to the first conductive path, and a magnetic field sensor placed within the drilling assembly of the second well and arranged to detect a field strength and direction of an electromagnetic field generated by the current applied to the first conductive path.

DETAILED DESCRIPTION OF THE INVENTION

Figure 1:
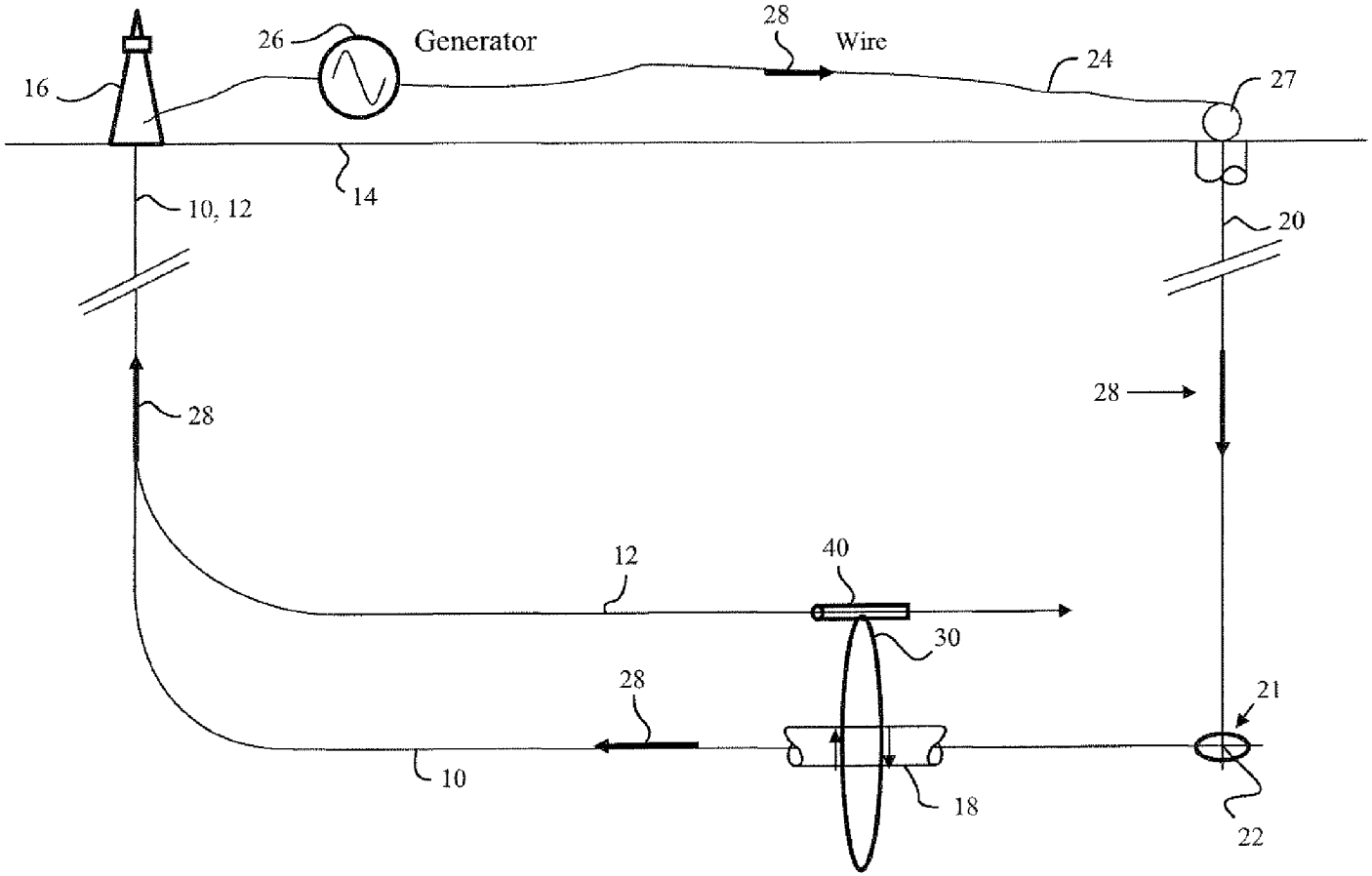
FIG. 1 is a schematic illustration of an elevation of a well plan for drilling twin horizontal wells.

FIG. 1 schematically illustrates a typical well plan for drilling twin horizontal wells 10, 12. From the earth's surface 14, the wells may be drilled from a single drilling platform 16, where the second well is drilled from a second position of the drilling rig, located a short distance from the position from which the first well was drilled. After initially being drilled substantially vertically, the inclination angles of wells are built until they are horizontal, drilling into a desired deposit of, for example, heavy oil or tar. The first well 12 is typically drilled and cased before drilling commences on the second horizontal well 10. The casing or slotted liner for a well is metallic and will conduct electric current. The horizontal portion of the first well may be below the second well by several meters, e.g., 4 to 10 meters.

A directional survey is made of the first well to locate the trajectory of the well and facilitate planning a surface location for a small, vertical borehole 20 which is a third well. This small borehole will preferably nearly intersect 21 the first well at the distal termination end of the first well. The small hole, with a temporary casing installed, preferably of a non-conductive material such as PVC installed, need only to be large enough to accommodate a special electrode 22 to be lowered to a position near the bottom and near to the first casing. The small vertical hole of the third well may be similar in size to a water well and may extend a few meters deeper than the first well.

In the embodiment shown in FIG. 1, a conductive path between the casing 18 in the first well 10 and the electrode in the third well may be enhanced if needed by pumping a suitable conductive fluid into the third well 20. The electrode 22 is lowered into the vertical hole to provide a current path through the small well. The electrode 22 electrically connects the casing or liner 18 (collectively "casing") of the first well to a conductive path, e.g. a wire, in the small bore hole 20. The conductive path may include earth between the electrode 22 extending from the third well and the distal end of the casing 18 of the first well. By pumping a conductive fluid into the earth between the distal end of the first well and the distal end of the third well, the conductivity of that region of earth is increased to facilitate the flow of current between the electrode 22 and the casing 18 of the first well.

An above ground conductive path, e.g., wires 24, connects the surface ends of the third well 20 and the casing or liner 18 of the first well 10 to an alternating-current (AC) electrical generator 26, or other source of time varying current. A hoist 27, with a depth measurement instrument, may lower and raise the wire and the electrode 22 in the third well. The hoist is connected to the insulated surface wire 24 and includes a spool of insulated wire to which the electrode 22 is attached. The hoist lowers the electrode 22 is preferably lowered to the depth of the first well casing. The electrical power from the generator drives a current 28 that flows through the wire 24, the third well 20, electrode 22, casing or liner of the first well 18 and is returned to the generator.

The alternating-current 28 produces an electromagnetic field 30 in the earth surrounding the casing 18 of the first well. The characteristics of an electromagnetic field from an AC conductive path are well-known. The strength of the electromagnetic field 30 is proportional to the alternating current applied by the generator. The magnitude of current in the casing may be measured with precision by an amp meter, for example. Because the strength of the magnetic fields is proportional to the current, there is a well-defined relationship between the current, measured magnetic field strength at the new well and the distance between the new well and casing of the first well. The strength and direction of the magnetic field are indicative of the distance and direction to the casing of the first well.

Figure 2:
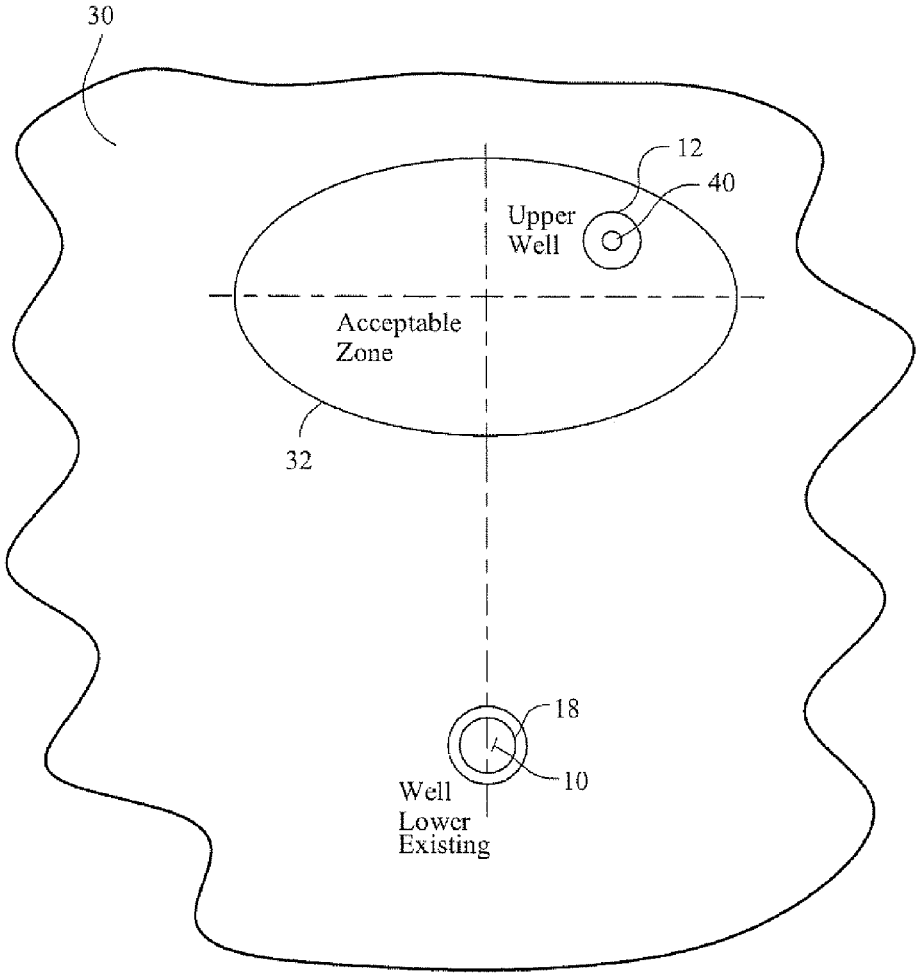
FIG. 2 is a schematic map of locations for twin horizontal boreholes and an acceptable region for the trajectory of the second well.

FIG. 2 is a schematic view of the first and second wells at a cross-sectional plane along the vertical sections through the wells. The electromagnetic field 30 emanates from the casing 18 of the first well 10 and into the surrounding earth. The second well 12 is shown as the upper well however the position of the first and second well may be reversed depending on the drilling application. A sensor assembly 40 in the second well senses the earth's magnetic and gravity fields, and the electromagnetic field emanating from the first well.

The acceptable drilling path of the second well is defined by a typical acceptable zone 32 that is shown in cross-section in FIG. 2. The acceptable zone 32 may be a region that is usually centered in the range of 4 to 10 meters from the first well. The zone 32 may have a short axis along a radius drawn from the upper well and a long axis perpendicular to a vertical plane through the upper well. The dimensions of the acceptable zone may be plus or minus one meter along the short axis and plus or minus two meters along the long axis of the zone. The shape and dimensions of the acceptable zone are known for each drilling application, but may differ depending on the application.

The drilling trajectory for the second well should remain within the acceptable zone 32 for the entire length of the horizontal portion of the two wells. The drilling guidance system, which includes the sensor assembly 40, is used to maintain the drilling trajectory of the second well within the acceptable zone. Whether the drilling trajectory of the second well 12 is within the acceptable zone 32 is determined based on the direction and strength of the electromagnetic field 30 along the second well path as sensed by the sensor assembly 40.

Measurements of the field intensity and field direction by the sensor assembly 40, in the second well provide information sufficient to determine the direction to the first well and the distance between the two wells. This information is provided to the driller in a convenient form so that he can take appropriate action to maintain the trajectories of the two wells in the proper relationship. The sensor assembly 40 is incorporated into the down hole probe of a wireline steering tool or MWD system for drilling the second well 12. The sensor assembly thus guides the drilling of the second well for directional control of the drill path trajectory.

As alternating current flows in the conductive casing 18 of the first well, the alternating electromagnetic fields produced in the region surrounding the conductor are predictable in terms of their field strength, distribution and polarity. The magnetic field (B) produced by a long straight conductor, such as the well casing, is proportional to the current (I) in the conductor and inversely proportional to the perpendicular distance (r) from the conductor. The relationship between magnetic field, current and distance is set forth in Biot-Savart's Law which states:

$$B = \bullet I/(2\pi r)$$

Where • is the magnetic permeability of the region surrounding the conductor and is constant. The distance (r) of the second bore hole from the casing of the first well can thus be determined based on the measurement of the current (I) in the casing and the magnetic field strength (B) at the second bore hole.

Figure 3:
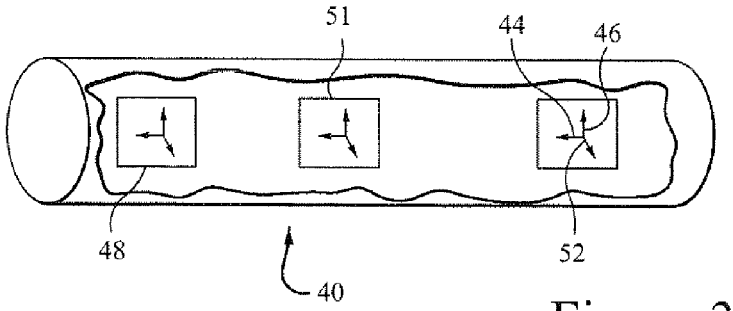
FIG. 3 is a schematic diagram of an exemplary magnetic sensor array.

FIG. 3 is a schematic diagram of a component-type sensor assembly 40 (shown in a cut-away view) having the ability to discriminate field direction. Component-type magnetic sensors, e.g., magnetometers, and accelerometers, are directional and survey sensors conventionally used in measurement-while-drilling (MWD) measurements. The sensor assembly 40 moves through the second bore hole typically a few meters behind the drill bit and associated drilling equipment. The sensor assembly 40 collects data used to determine the location of the second bore hole. This information issues to guide the drill bit along a desired drilling trajectory of the second well.

The sensor assembly 40 includes both standard orientation sensors, such as three orthogonal magnetometers 48 (to measure the magnetic field of the earth), three orthogonal accelerometers 51 (to measure the gravity field of the earth), and three highly-sensitive orthogonal alternating-field magnetic sensors 44, 46, 52 for detection of the electro magnetic field about the first (reference or producer) well. The magnetic sensors, have a component response pattern and are most sensitive to alternating magnetic field intensity corresponding to the frequency of the alternating current source. These sensors are mounted in a fixed relative orientation in the housing for the sensor assembly.

A pair of radial component-magnetic sensors 44 46 and 52 (typically three sensors) are arranged in the sensor assembly 40 such that their magnetically sensitive axes are mutually orthogonal. Each component sensor 44, 46 and 52 measures the relative magnetic field (B) strengths at the second well. The sensors will each detect different field strengths due to their orthogonal orientations. The direction on the field (B) may be determined by the inverse tangent ($\tan^{-1}$) of the ratio of the field strength sensed by the radial sensors 44, 46. The frame of reference for the radial sensors 44, 46 is the earth's gravity and magnetic north, determined by the conventional magnetic sensors 48 and the gravity sensors 51. The direction to the conductor of current is calculated by adding 90 degrees to the direction of the field at the point of measurement. The direction from the sensors to the first well and the perpendicular distance between the sensors and the first well provides sufficient information to guide the trajectory of the second well in the acceptable zone 32.

Figure 4:
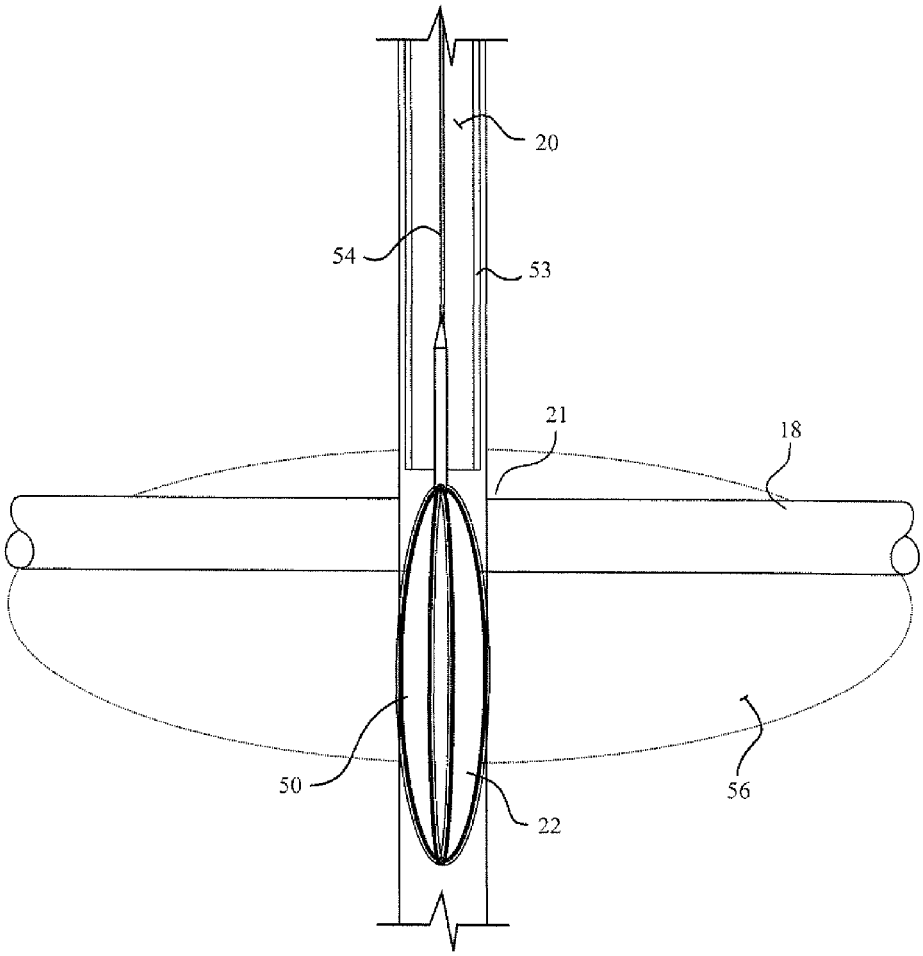
FIG. 4 is a schematic diagram of an exemplary electrode assembly for placement in a third well.

FIG. 4 is a schematic illustration of an exemplary electrode 22 lowered into the small vertical hole 20 to the zone where conductive fluid has been introduced. The electrode 22 includes metallic bow springs 50 e.g., an expandable mesh, that expand to contact the walls of the open borehole of the well 20. The spring elements 50 also retract to a size which slides through the temporary casing 53 of the vertical well 20. The temporary casing insures that the material around the borehole does not slough into the hole. The electrode 22 is positioned near the first casing 18 at the nearest to a point of intersection 21 of the two wells. A conductive fluid in the third well 20 seeps into the earth 56 surrounding the intersection 21 between wells. The conductive fluid enhances the electrical connectivity of the earth between the first casing and the electrode in the third well. The electrode is connected to the insulated conductor wire 54 that extends through the well 20 and to the surface. The wire 54 is connected via wire 24 to the return side of the generator.

Figure 5:
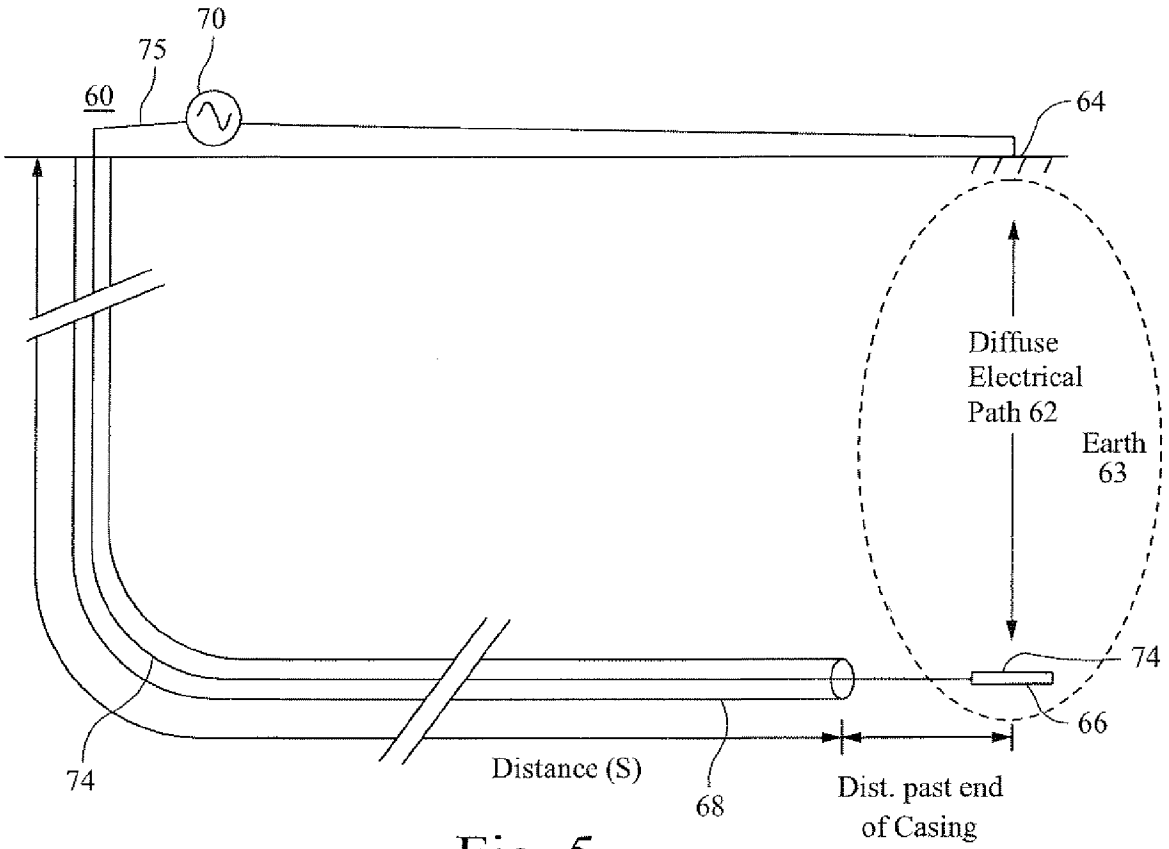
FIG. 5 is a side view of an exemplary drilling guidance system forming an electrical path through earth between an earth ground surface electrode and an electrode extending beyond the end of an existing underground well casing.

FIG. 5 is a side view of an exemplary drilling guidance system 60 forming an electrical path 62 through a region of earth 63 between an ground surface electrode 64 and an electrode 66 extending beyond the end of an existing underground well casing 68.

The electrode 66 extends a few meters, e.g., ten or more, beyond the distal end of the well casing 68. The distance between the electrode 66 and the end of the well casing should be sufficient to avoid current flowing from the electrode 66, up through the casing of the first well and to the surface electrode.

Well casings are conventionally metallic and have slots to allow steam and other gases to vent to the earth. Electromagnetic fields generated by the low frequency of the AC current source, e.g., preferably below 10 Hertz and most preferably at 5 Hertz, are not significantly attenuated by the slotted metallic casings in conventional wells. The electromagnetic fields generated by the current in the insulated wire passes through the slots in the casing and into the earth. Eddy currents on the casing that could interfere with the electromagnetic field are not significant due to the low frequency of the AC source.

An alternating current (AC) source 70 applies an AC current to the return ground electrode 64 and to the underground electrode 66 to form an electrical current path including 62, e.g., producing a diffuse electrical field, through the earth 63 between the ground electrode 64 at or near the surface and the underground electrode 66. A wire 74 with an insulated covering extends from the AC power source 70, through the entire length (S) of the well casing 68 and through the extended borehole a distance past the distal end of the well casing to the electrode 66, contacting the earth. The current path 62 through the earth and to the return ground electrode 64 completes an electrical circuit that includes the AC source 70, wire 74 and electrode 66.

The current path 62 through the earth and to the return ground electrode 64 completes an electrical circuit that includes the AC source 70, wire 74 and electrode 66. Preferably, the wire 74 extending down through the first well casing to the underground electrode 66 is insulated and has steel armor to provide mechanical strength to the wire. Electromagnetic fields from the wire 74 pass through insulation, armor and the well casing 68 and into the earth. The steel armor provides mechanical strength to the wire.

The surface wire 75 to the wire 74 and the surface wire 24 and wire 112 extending down the third well may have shielding to prevent electromagnetic fields from these wires from generating spurious electromagnetic fields that enter the earth. Further, the connections between the current source and the wire 74 and the current source and surface wire 78 are established to avoid current leakage to ground. Care is taken in setting up the electrical circuit for the drilling guidance system to ensure that current does not unintentionally leak to ground and that unwanted electromagnetic fields are not created that may affect the data collected by the sensors 88.

The alternating current in the wire 74 generates an electromagnetic field that extends around and beyond the casing 68 of the first well. A known current value is applied to the wire 74 and electrode 66. Knowing the current in the wire 74, a calculation, e.g. an application of Ampere's Law, can be made to estimate the electromagnetic field at any given distance from the wire 74 and the well casing 68. This calculated distance can be used to guide the drilling of a second well.

Figure 6:
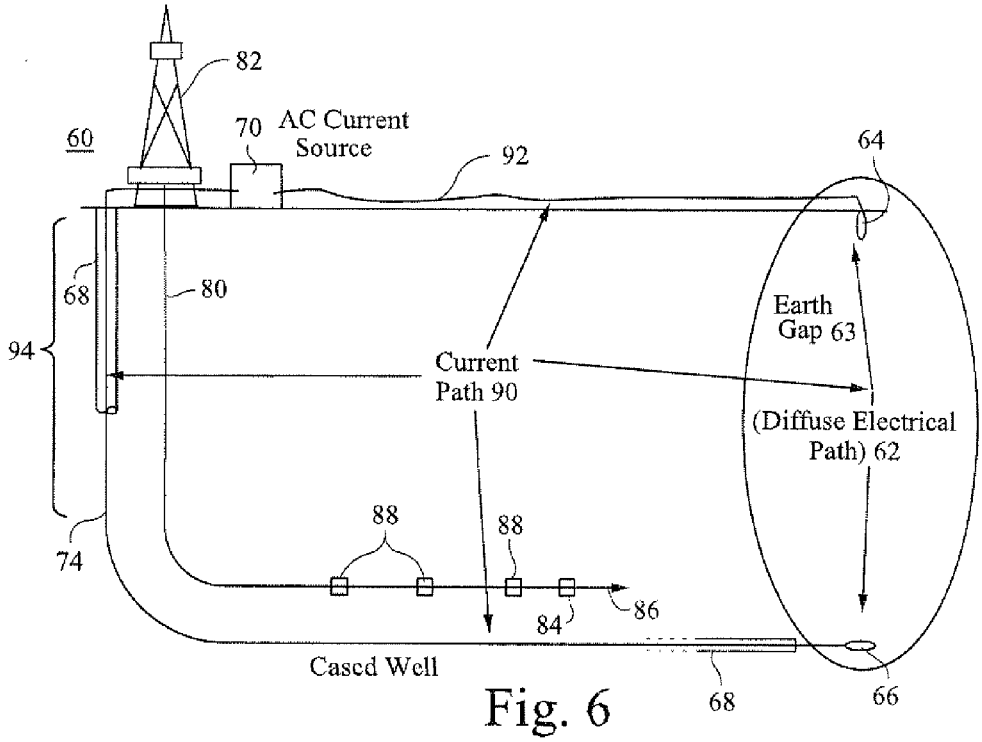
FIG. 6 is a side view of an exemplary drilling guidance system in which current flows along a conductor inside the entire length of a casing of a first well, through earth between an electrode extending from the end of the casing and a ground electrode.

FIG. 6 is a side view of the drilling guidance system 60 in which a second well 80 is being drilled parallel to the first well 68. A drilling rig 82, which may be the same rig used for the first well, guides a drill head 84 forming the second well along a trajectory 86 that is parallel to the first well casing 68. Electromagnetic sensors 88 in the second well and behind the drill head detect the electromagnetic field from the first well 68 and wire 80 in the well. A current path 90 extends from the AC current source 70, along the wire 74 extending the length of the first well casing 68 and out from the distal end of that casing to the electrode 66, through the diffuse electrical path 62 in the earth 63 between the electrode 66 and return ground electrode 64, and from the return ground electrode along the return wire 92 to the source 70.

The AC sensors 88 are positioned approximately 18 or 20 meters behind the bit, thus will not be affected by the more concentrated current in the region where the current leaves the electrode and becomes more and more diffused as it moves away from the electrode. In practice, the AC sensors in the Injector well will be located some 40 or more meters behind the electrode at the closest point, which will be near the termination of drilling of the (lower) Injector well.

The calculation of the estimated electromagnetic field strength at a distance from the first well casing is used to estimate the distance from the first well casing of a second well trajectory 86 being drilled parallel to the first well casing 68. Because the strength of the magnetic field at any distance from first well casing can be calculated, the measured field strength from the sensors 88 can be used to determine the distance between the second well and the first well. This information regarding the distance between the positions of the electromagnetic sensors 88 in the second well will be used to guide the trajectory of the drilling head 84 along a path parallel to the first well casing.

The calculation of the electromagnetic field around the first well casing may also account for other elements of the AC circuit that contribute to the magnetic field detected by the sensors 88 in the second well. For example, electromagnetic fields that extend into the ground may be produced by the surface mounted return wire 92 carrying current between the AC power source 70 and the return ground electrode 64, e.g., a rod. Similarly, the current-conducting wire 74 in the vertical section 94 of the first well casing 68 produces an electromagnetic field in the earth. These additional electromagnetic fields should preferably be taken into account in calculating an expected field intensity in the region of the earth near the horizontal portion of the first well. Calculations of expected electrical field strength from a variety of current sources, e.g., wire 92, the vertical portion 84 of wire 74 and the diffuse electrical current 62 in the earth region 63, can be accomplished with known computational techniques for calculating electrical field strengths. Preferably, the calculations of the expected field intensity and the measurement of the field intensity by sensors in the second well are conducted in real time and substantially simultaneously.

The current 62 in the region of earth 63 between the electrode and the ground rod is so thoroughly diffused that the field resulting from this current will not be detected at by the AC sensors 88 at their positions in the second well. Thus, the current 62 can be ignored for purposes of calculating the electromagnetic field around the casing of the first well. The electromagnetic field strength of the current 62 in the earth 63 may relatively strong in the vicinity of the distal end of the first well. However, it is not needed to measure the field at the distal end of the first well because this point is at or near the end of the second drilling path 86. At the end of the path there is likely to much less need, if any, to monitor the field because the drilling path is nearly complete and the trajectory will not significantly change further.

Deployment of the electrode outside the first well (the Producer well) 68 casing into open hole may be done in a variety of ways. The electrode may be pumped down through whatever tubular is used to run it into the hole, pushed into position with an extension of the tubing or drill pipe used to lower it into the hole, or it may be pushed into place with an extended well tractor. Yet another possibility is the use of coiled tubing to push it into place.

Assuming that a suitable method of deployment is developed, this method may well be more accurate than the three-well method because of the lossless current conduction by the wire inside the pipe, with no loss of accuracy due to poor information about the conductivity of formations surrounding the casing.

Figure 7:
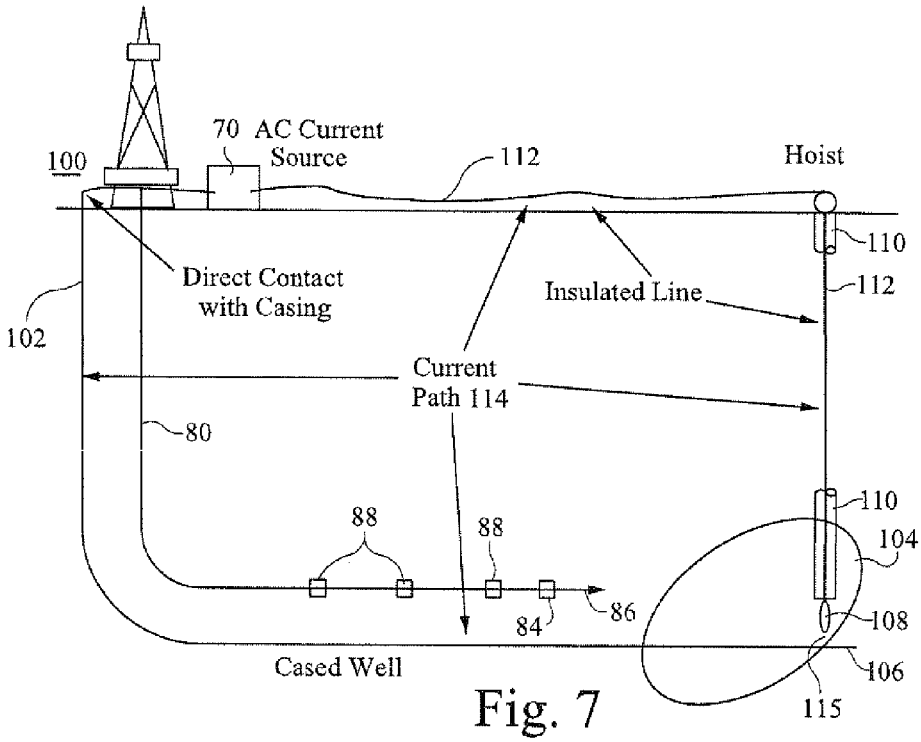
FIG. 7 is a side view of an exemplary drilling guidance system in which current flows along the entire length of a casing of a first well, through earth between the distal end of the casing of a first well and an electrode lowered into a third well extending near to but not intersecting with the casing of the first well.

FIG. 7 is a side view of another exemplary drilling guidance system 100 in which current flows along the entire length of a conductive casing 102 of a first well, through a region of earth 104 between a distal end 106 of the casing and a return ground electrode 108 lowered into a third well casing 110 extending near to but not intersecting with the casing 102 of the first well. A current source 70 applies current directly to the conductive casing 102 of the first well and to a conductive return wire 112 extending along the surface from the source 70 to and down the third well 110 to the return ground electrode 108. The return ground electrode 108 extends beyond the distal end of the casing of the third well into open borehole in the earth and is connected to the return wire that extends through the casing, which is preferably non-conductive, of the third well.

A diffuse electrical current path 115 is formed in the earth between the return electrode 108 and the casing of the first well. This electrical path is included in the current path 114 extending from the source 70, casing 102 of the first well, return electrode 108 and return wire 112. The return electrode is positioned close to the first well casing (and preferably in contact with the casing) to reduce the electrical path through earth between the casing and the return electrode.

The current path 114 includes the current in a horizontal portion of the casing 102 of the first well which generates an electromagnetic field around the casing that is detected by sensors 88 in a second well 80 being drilled by a drill head 84 following a desired drilling trajectory 86. By measuring the electromagnetic field at the sensors 88 and knowing the current in the casing of the first well, the distance between these sensors in the second well 80 can be used to calculate the distance between the first well and the second well, from the location of the sensors.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to guide a drilling path of a second well in proximity to a first well comprising:

extending a first electrode connected to a first conductive wire through a casing or liner of the first well and extending the first electrode into an uncased borehole beyond a distal end of the casing or liner such that the first conductive and unshielded wire extends through the length of the casing or liner of the first well;

positioning a return ground electrode in the ground of the earth, such that the return ground electrode is nearer the first electrode extending into the uncased borehole than to the casing or liner of the first well;

after positioning the return ground electrode, establishing a time varying electrical current in the first conductive wire and the first electrode by applying current from a time varying electrical current source to the first conductive wire and the first electrode, and to a second conductive wire extending to the return ground electrode, wherein current flows from the first electrode through earth to the return ground electrode;

generating an electromagnetic field around the casing or liner of the first well from the time varying electrical current in the first conductive wire;

drilling a second well along a drilling trajectory parallel to the first well;

from the drilling assembly in the second well, sensing the electromagnetic field generated around the casing or liner of the first well, and guiding the drilling trajectory of the second well using the sensed electromagnetic field.

2. The method of claim 1 wherein the return ground electrode is positioned proximate to a surface of the earth.

3. The method of claim 1 wherein the time varying electrical current has a frequency of no more than ten Hertz.

* * * * *